US007172387B2

(12) United States Patent
Yamamoto et al.

(10) Patent No.: US 7,172,387 B2
(45) Date of Patent: Feb. 6, 2007

(54) FAN GUARD FOR BLOWER UNIT

(75) Inventors: Jiro Yamamoto, Sakai (JP); Zhiming Zheng, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/504,271

(22) PCT Filed: Nov. 7, 2003

(86) PCT No.: PCT/JP03/14229

§ 371 (c)(1),
(2), (4) Date: May 24, 2005

(87) PCT Pub. No.: WO2004/042288

PCT Pub. Date: May 21, 2004

(65) Prior Publication Data

US 2005/0238481 A1 Oct. 27, 2005

(30) Foreign Application Priority Data

Nov. 8, 2002 (JP) ..... 2002-325284

(51) Int. Cl.
*F04D 29/70* (2006.01)

(52) U.S. Cl. ..... 415/121.2; 415/119; 415/211.2; 416/247 R

(58) Field of Classification Search ..... 415/119, 415/121.2, 185, 191, 208.2, 211.2; 416/247 R; 62/419, 426

See application file for complete search history.

(56) References Cited

U.S. PATENT DOCUMENTS 2,950,859 A * 8/1960 Kirk ..... 415/191
6,015,265 A * 1/2000 Lasko et al. ..... 416/247 R
6,364,618 B1 * 4/2002 Moreno ..... 416/247 R
6,454,537 B1 * 9/2002 Perella et al. ..... 416/247 R
6,695,577 B1 * 2/2004 Susek ..... 415/121.2
6,764,277 B2 * 7/2004 Somahara et al. ..... 415/121.2
6,899,521 B2 * 5/2005 Horng et al. ..... 415/208.2

FOREIGN PATENT DOCUMENTS

| | | | | |
|---|---|---|---|---|
| DE | 101 39 542 A1 | | 3/2003 | |
| JP | 54-100135 A | | 8/1979 | |
| JP | 57-16740 A | * | 1/1982 | ..... 416/247 R |
| JP | 57-179523 A | | 11/1982 | |
| JP | 9-310890 A | | 12/1997 | |
| JP | 2002-195610 A | | 7/2002 | |
| WO | WO-02/061343 A1 | | 8/2002 | |

* cited by examiner

*Primary Examiner*—Christopher Verdier
(74) *Attorney, Agent, or Firm*—Birch, Stewart, Kolasch & Birch, LLP

(57) ABSTRACT

A fan guard includes a plurality of extending ribs extending from a blocking plate to an outer frame, a plurality of inner ribs arranged between the extending ribs and extending from the blocking plate to the substantial center in the radial direction, and a plurality of outer ribs arranged between the extending ribs and extending from the substantial center in the radial direction to the outer frame. The number of the inner ribs is set smaller than the number of the outer ribs. Hence, strength to prevent bending of the fan guard due to load application in the axial direction is ensured and increase in ventilating resistance of forced airflow (W) from a blower fan is suppressed.

17 Claims, 12 Drawing Sheets

FAN GUARD FOR BLOWER UNIT

FIELD OF THE INVENTION

The present invention relates to fan guards for an air blower unit having blower fans which are mounted at air outlets of the air blower unit.

BACKGROUND OF THE INVENTION

There are air blower units provided in outdoor units of air conditioners, in which, for example, fan guards are provided at air outlets of blower fans for protecting the blower fans.

As the above fan guards, there are well known fan guards in which many radially arranged radial ribs and many coaxially arrange annular ribs are formed integrally by a synthetic resin. The radial ribs and the annular ribs of such fan guards made of a synthetic resin have flat sections along the direction of the rotation axis of the blower fans for maintaining the strength and reducing pressure loss of forced airflow flowing between the ribs.

As a function that the fan guards with such a structure are required to have, the fan guards should have enough strength to prevent fingers or foreign matters from entering in error between the annular ribs.

Pushing an object of a given size with a given force expands the intervals of the annular ribs, so that the object enters. As the strength of the fan guards with the above structure to prevent this entering, strength at the outermost peripheral part where the intervals of the radial ribs become the widest is used as a reference value for design.

However, the intervals of the radial ribs of the fan guards of this type are narrower as it approaches the center, which invites increase in ventilating resistance and in noise. In order to tackle these disadvantages, a fan guard has been proposed which restrains excessive increase in the ventilating resistance in the interior part by thinning the radial ribs inside a point where the intervals of the radial ribs are smaller as it goes inward and the rib density is twice as high as a reference, which means intervals of the radial ribs at the outermost periphery (for example, Japanese Patent Application Laid Open Publication No. 2002-195610).

Problems to be Solved

Referring to fan guards of air blower units used in apparatuses provided outdoors, such as outdoor units for air conditioners, it includes providing a function of preventing breakage of the blower fan, which results from contact with the rear edge of a vane of the blower fan due to bending of the fan guard, in addition to the function of preventing foreign matter from entering between the annular ribs. The causes of the fan guard bending include: an object such as a ball collides with the fan guard, to bend the central part of the fan guard; snow in winter accumulates on the fan guard where the rotary shaft of the blower fan is arranged perpendicularly upward, so that the weight of the snow bends the fan guard.

The fan guards with the above structure are fixed at outer frames thereof to the unit bodies. Therefore, the radial ribs works more than the annular ribs for preventing deformation due to load application to the central parts of the fan guards. Hence, the number, the arrangement, the shape of the section and the like of the radial ribs influence much the strength against bending.

However, in the case where the inner radial ribs are thinned in the fan guard as disclosed above, the increase in the ventilating resistance is suppressed while the strength against bending at the central part decreases, with a result that the fan guard is liable to be deformed due to load application to the central part. Thus, the vanes of the blower fan may come into contact with the thus deformed part of the fan guard.

The present invention has been made in view of the above problems and features preventing the increase in the ventilating resistance of the forced airflow while ensuring strength to prevent rib expansion and the strength to prevent bending of the fan guard.

SUMMARY OF THE INVENTION

A first invention is directed to a fan guard of a blower unit which is provided with, between a blocking plate 14 arranged at a central part and an outer frame 15 arranged at an outer periphery, a plurality of annular ribs 16, 16 . . . arranged coaxially in a radial direction at predetermined intervals with a center of the blocking plate 14 as a center, and a plurality of radial ribs 17, 17 . . . extending radially from the blocking plate 14 to the outer frame 15 and arranged at regular intervals in a peripheral direction, and which is mounted at an air outlet 9 of a blower unit A having a blower fan 3. The radial ribs 17, 17 . . . includes a plurality of inner ribs 17B, 17B . . . extending from the blocking plate 14 to a substantial center in the radial direction and arranged at regular intervals in the peripheral direction, and a plurality of outer ribs 17C, 17C . . . extending from the substantial center in the radial direction to the outer frame 15 and arranged at regular intervals in the peripheral direction.

In addition, the number of the inner ribs 17B, 17B . . . is set smaller than the number of the outer ribs 17C, 17C . . . .

According to the first invention, sufficient strength to prevent expansion of the annular ribs 16, 16 . . . in the radial direction when a foreign mater enters between the annular ribs 16, 16 . . . is ensured.

Further, the inner ribs 17B are connected to the blocking plate 14, whereby less number of the inner ribs 17B than that of the outer ribs 17C invites no lowering of the strength at the central part of the fun guard 4. Moreover, sufficient strength to prevent bending of the fan guard 4 at load application in the axial direction can be ensured and the increase in ventilating resistance of the forced airflow W from the blower fan 3 is suppressed.

As a result, the fan guard 4 is prevented from coming into contact with the blower fan 3 due to deformation of the fan guard 4 and noise and required input energy of the blower fan 3 are reduced.

In a second invention, the radial ribs 17, 17 . . . include a plurality of extending ribs 17A, 17A . . . extending from the blocking plate 14 to the outer frame 15 and arranged at regular intervals in the peripheral direction in the fan guard of the first invention. The inner ribs 17B, 17B . . . are arranged between the extending ribs 17A, 17A . . . , and the inner ribs 17B, 17B . . . and the extending ribs 17A, 17A . . . are arranged at regular intervals in the peripheral direction. Further, the outer ribs 17C, 17C . . . are arranged between the extending ribs 17A, 17A . . . and the outer ribs 17C, 17C . . . , and the extending ribs 17A, 17A . . . are arranged at regular intervals in the peripheral direction.

According to the second invention, the blocking plate 14 and the outer frame 15 are connected with each other by means of the plural extending rib 17A, whereby strength against the load application in the axial direction to the fan guard 4 is increased.

In a third invention, a thickness t' of the extending ribs 17A, 17A . . . is set greater than each thickness t" of the inner ribs 17B, 17B . . . and the outer ribs 17C, 17C . . . in the second invention.

According to the third invention, the rigidity of the extending ribs 17A, 17A . . . is increased, which increases strength to prevent deformation of the fan guard 4.

In a fourth invention, a length D of the extending ribs 17A, 17A . . . in a flow direction of forced airflow W from the blower fan 3 is set longer than each length D' of the inner ribs 17B, 17B . . . and the outer ribs 17C, 17C . . . in the flow direction of the forced air flow W in the second invention.

According to the fourth invention, the rigidity of the extending ribs 17A, 17A . . . is further increased, which further increases the strength to prevent deformation of the fan guard 4.

In a fifth invention, one of the annular ribs 16 functions as a boundary annular rib 16B serving as a boundary of an inner region Zi and an outer region Zo to which the inner ribs 17B, 17B . . . and the outer ribs 17C, 17C . . . are connected in the first or second invention. Further, a thickness t of the annular ribs 16, 16 . . . in the inner region Zi increases gradually from the central part to the boundary annular rib 16B. A thickness t of the boundary annular rib 16B is the greatest and a thickness t of outer annular ribs 16C located outside the boundary rib 16B decreases. In addition, a thickness t of the annular ribs 16, 16 . . . in the outer region Zo increases from the thinner annular ribs 16C toward the outer periphery.

According to the fifth invention, sufficient strength to prevent expansion of the annular ribs 16, 16 . . . in the radial direction is ensured because the thickness t of the annular ribs 16, 16 . . . is set greater correspondingly as the intervals of the inner ribs 17B, 17B . . . and the outer ribs 17C, 17C . . . increase. Further, the thickness t of the boundary annular rib 16B, which serves as the boundary between the inner region Zi and the outer region Zo to which the inner ribs 17B, 17B . . . and the outer ribs 17C, 17C . . . are connected, is the greatest, whereby the boundary annular rib 16B exhibits a function as an outer frame for the inner ribs 17B, 17B . . . and a function as an inner frame for the outer ribs 17C, 17C . . . Thus, the strength of the fan guard 4 is increased as a whole.

In a sixth invention, a chord direction of the radial ribs 17, 17 . . . in a rib section on a plane F parallel to a rotary shaft 13*a* of the blower fan 3 inclines with respect to a rotation axis in the first or second invention. Further, an inclined angle α' of the radial ribs 17, 17 . . . in the chord direction changes in the radial direction so that the incline angle α' corresponds to an inclined angle α of the forced airflow W of the blower fan 3.

In other words, the radial ribs 17, 17 . . . inclines with respect to the rotation axis on the reference plane F parallel to the rotary shaft 13*a* of the blower fan 3 and the inclined angle α' of the radial ribs 17, 17 . . . changes in the radial direction so as to correspond to the inclined angle of the forced airflow W of the blower fan 3.

According to the sixth invention, the forced airflow W from the blower fan 3 flows along the radial ribs 17, 17 . . . of the fan guard 4 in the entire region in the radial direction of the fan guard 4. As a result, interference between the forced airflow and the radial ribs, which is caused in the case where there is a region where the inclined angle of the forced airflow does not agree with the inclined angle of the radial ribs (that is, the blocking plate 14 side and the vicinity of the outer periphery), is not caused, resulting in reduction of noise and pressure loss.

In a seventh invention, a range of the inclined angle α' of the radial ribs 17, 17 . . . in the sixth invention includes: a constant region Z0 where the inclined angle α' is the smallest at a center between the blocking plate 14 and the outer frame 15 and is substantially constant in a predetermined region; a decreasing region Z1 on the blocking plate 14 side with respect to the constant region Z0 where the inclined angle α' decreases as it goes from the blocking plate 14 toward the constant region Zα; and an increasing region Z2 on the outer frame 15 side with respect to the constant region Z0 where the inclined angle α' increases as it goes toward the outer frame Zo.

According to the seventh invention, the change in the inclined angle α (see FIG. 16) of the forced airflow W with respect to the radial direction point (dimensionless R=radius/radius of fan guard) agrees with the inclined angle α' of the radial ribs 17, 17 . . . in the entire region in the radial direction. As a result, the interference between the forced airflow and the radial ribs, which is caused in the case where there is a region where the inclined angle α of the forced airflow W does not agree with the inclined angle α' of the radial ribs 17, 17 . . . (that is, the blocking plate 14 side and the vicinity of the outer periphery), is hardly caused, resulting in reduction of noise and pressure loss.

In an eighth invention, the inclined angle α' of the radial ribs 17, 17 . . . changes within a range from 20 degrees to 50 degrees in the sixth invention.

According to the eighth invention, the inclined angle α' of the radial ribs 17, 17 . . . can be appropriately set in the entire region in the radial direction, with a result that noise and pressure loss are surely reduced.

In a ninth invention, the annular ribs 16, 16 . . . located outside the substantial center in the radial direction inclines outward and an inclined angle β thereof gradually decreases as it approaches the annular ribs 16, 16 . . . in the vicinity of the outermost periphery in the first or second invention.

According to the ninth invention, the forced airflow W from the blower fan 3 (that is, outwardly expanding flow) flows along the annular ribs 16, 16 . . . Accordingly, interference between the annular ribs 16, 16 . . . and the forced airflow W is reduced and the flow direction of the forced airflow W flowing between the annular ribs 16 is corrected in the axial direction in the vicinity of the outermost periphery. As a result, no phenomenon of blocking the forced airflow W is caused, thereby contributing to the reduction of pressure loss.

In a tenth invention, the outer frame 15 is in parallel to or inclines inward with respect to the rotary shaft 13*a* of the blower fan 3 and an inclined angle of an outermost annular rib 16A out of the annular ribs 16, 16 . . . is substantially equal to an inclined angle of the outer frame 15 in the first or second invention.

According to the tenth invention, the forced airflow W smoothly flows between the outermost annular rib 16A and the outer frame 15. As a result, noise increase is suppressed and pressure loss is reduced.

Effects of the Invention

According to the present invention, sufficient strength to prevent expansion of the annular ribs 16, 16 . . . in the radial direction when a foreign matter enters between the annular ribs 16, 16 . . . is ensured Further, the inner ribs 17B are connected to the blocking plate 14, whereby less number of the inner ribs 17B than the number of the outer ribs 17C invites no lowering of the strength at the central part of the fan guard 4, ensures the strength to prevent bending of the fan guard 4 at load application in the axial direction and suppresses the increase in the ventilating resistance of the forced airflow W from the blower fan 3. As a result, contact of the fan guard 4 into the blower fan 3 due to deformation of the fan guard 4 can be prevented and reduction of noise and required input energy of the blower fan 3 are implemented.

According to the second invention, the blocking plate 14 and the outer frame 15 are connected by means of the plural radial ribs (extending ribs 17A), whereby the strength against the load application in the axial direction to the fan guard 4 is increased.

According to the third invention, the rigidity of the extending ribs 17A, 17A . . . is increased, which increases the strength against deformation of the fan guard 4.

According to the fourth invention, the rigidity of the extending ribs 17A, 17A . . . is further increased, which further increases the strength against deformation of the fan guard 4.

According to the fifth invention, the thickness t of the annular ribs 16, 16 . . . becomes greater as the intervals of the inner ribs 17B, 17B . . . and the outer ribs 17C, 17C . . . increase, whereby sufficient strength to prevent expansion of the annular ribs 16, 16 . . . in the radial direction can be ensured. In addition, the thickness t of the boundary annular rib 16B, which serves as the boundary between the inner region Zi and the outer region Zo to which the inner ribs 17B, 17B . . . and the outer ribs 17C, 17C . . . are connected, is the greatest, whereby the boundary annular rib 16B exhibits a function as an outer frame for the inner ribs 17B, 17B . . . Also, the boundary annular rib 16B exhibits a function as an inner frame for the outer ribs 17C, 17C . . . , which means increase in the strength of the fan guard 4 as a whole.

According to the sixth invention, the interference between the forced airflow and the radial ribs, which is caused in the case where there is a region where the inclined angle $\alpha$ of the forced airflow W does not agree with the inclined angle $\alpha'$ of the radial ribs 17, 17 . . . (that is, the blocking plate 14 side and the vicinity of outer periphery), is not caused, resulting in reduction of noise and pressure loss.

According to the seventh invention, the change in the inclined angle $\alpha$ (see FIG. 16) of the forced airflow W with respect to the radial direction point (dimensionless R=radius/radius of fan guard) agrees with the inclined angle $\alpha'$ of the radial ribs 17, 17 . . . in the entire region in the radial direction. As a result, the interference between the radial ribs and the forced airflow, which is caused in the case where there is a region where the inclined angle $\alpha$ of the forced airflow W does not agree with the inclined angle $\alpha'$ of the radial ribs 17, 17 . . . (that is, the blocking plate 14 side and the vicinity of the outer periphery), is hardly caused, resulting in reduction of noise and pressure loss.

According to the eight invention, the inclined angle $\alpha'$ of the radial ribs 17, 17 . . . can be appropriately set in the entire region in the radial direction, with a result that noise and pressure loss are surely reduced.

According to the ninth invention, the forced airflow W from the blower fan 3 (that is, outwardly expanding flow) flows along the annular ribs 16, 16 . . . Accordingly, the interference between the annular ribs 16, 16 . . . and the forced airflow W is reduced and the flow direction of the forced airflow W flowing between the annular ribs 16 is corrected in the vicinity of the outermost periphery. As a result, no phenomenon of blocking the forced airflow W is caused, thereby contributing to the reduction of pressure loss.

According to the tenth invention, the forced airflow W smoothly flows between the outermost annular ribs 16A and the outer frame 15. As a result, the noise increase is suppressed and pressure loss is reduced.

BEST MODE FOR CARRYING OUT THE INVENTION

Several preferred embodiments of the present invention will be described hereinafter with reference to accompanying drawings.

First Embodiment

FIG. 1 through FIG. 8 show a fan guard of a blower unit according to the first embodiment of the present invention.

Figure 1:
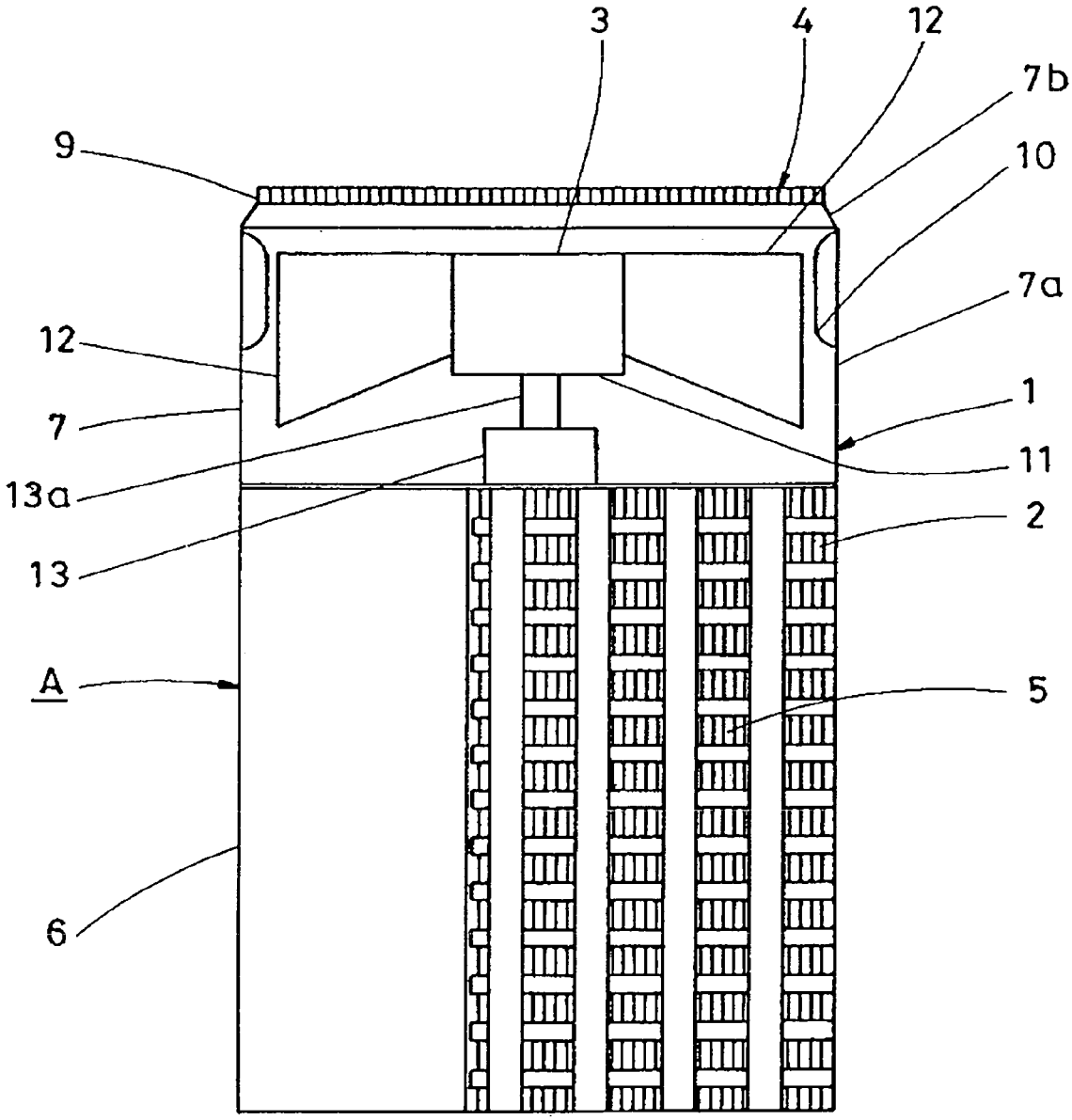
FIG. 1 is a side view partly in section of a blower unit (outdoor unit) using a fan guard according to a first embodiment of the present invention.

The fan guard 4 is, as shown in FIG. 1, mounted to an outdoor unit A (one example of a blower unit) of an air conditioner. The outdoor unit A is of an up-blast type which sucks outside air from the side faces, cools or heats the thus sucked outside air by heat exchange with a refrigerant and blows the thus cooled or heated air upward.

The outdoor unit A is provided with a casing 1 in a rectangular shape in vertical section having air intake ports 5 on three side faces (only one side face is shown in FIG. 1), a heat exchanger 2 in a U-shape in section arranged along each of the air intake ports 5 in the casing 1, a blower fan 3 for sucking in and blowing out outside air, and a fan guard 4 arranged at the upper end opening part of the casing 1. Wherein, the outdoor unit A is provided with a control section arranged inside the casing 1 so as to face to the heat exchanger 2, and a compressor for compressing the refrigerant, though not shown in FIG. 1.

The casing 1 includes a casing body 6 in a rectangular shape of which upper part is opened, and an upper lid member 7 that covers the upper opening of the casing body 6. The casing body 6 is in a box shape made of a thin metal plate formed by, for example a plating process.

The upper lid member 7 is an integrally formed component made of a synthetic resin and includes a mount portion 7*a* in a rectangular shape in section mounted on the upper opening of the casing body 6, and a wall portion 7*b* in a circular shape extended and narrowed in a tubular shape from the upper end of the mount portion 7*a*. The upper end of the wall portion 7*b* serves as an air outlet 9 to which the fan guard 4 is fitted. A bell mouth 10 substantially in a cylindrical shape of which upper and lower parts are expanded is provided inside the upper part of the mount portion 7*a* of the upper lid member 7.

The blower fan 3 is an axial fan composed of a cylindrical hub 11 located at the center and a plurality of vanes 12, 12 . . . arranged around the hub 11, and is arranged inside the bell mouth 10. The blower fan 3 is driven and rotated by a fan motor 13 having a rotary shaft 13*a* pivotally mounted at the center of the hub 11. The fan motor 13 is mounted at the upper end of the casing body 6 by means of a support tool (not shown in the drawing).

Figure 2:
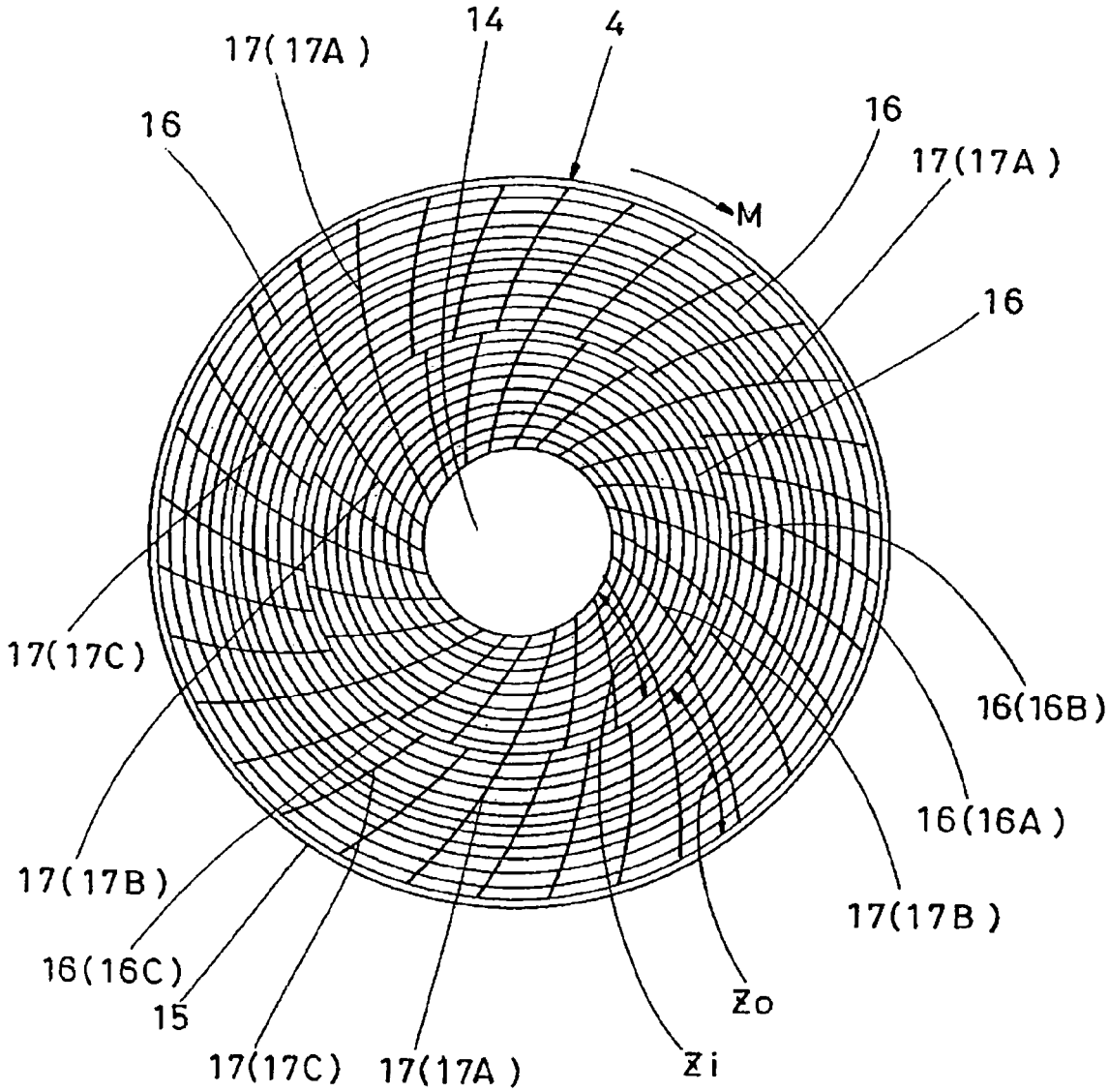
FIG. 2 is a plan view showing the fan guard of the blower unit according to the first embodiment of the present invention.

As shown in FIG. 2, the fan guard 4 is provided with, between a circular blocking plate 14 arranged at the central part and an annular outer frame 15 arranged at the outer periphery, annular ribs 16, 16 . . . arranged at predetermined intervals in the radial direction coaxially with the center of the blocking plate 14 as a center, and radial ribs 17, 17 . . . extending radially from the blocking plate 14 toward the outer frame 15.

The radial ribs 17, 17 . . . includes: a plurality (8 in the present embodiment) of extending ribs 17A, 17A . . . extending from the blocking plate 14 to the outer frame 15;

inner ribs 17B, 17B . . . extending from the blocking plate 14 to the substantial center in the radial direction in an inner region Zi ranged from the blocking plate 14 to the substantial center in the radial direction; and outer ribs 17C, 17C . . . extending from the substantial center in the radial direction to the outer frame 15 in an outer region Zo ranged from the substantial center in the radial direction to the outer frame 15.

In this case, the extending ribs 17A, 17A . . . are arranged at regular intervals in the peripheral direction and three outer ribs 17C, 17C, 17C and two inner ribs 17B, 17B are arranged at regular intervals in the peripheral direction between adjacent extending ribs 17A, 17A. In other words, this case is so set that m=3 wherein the number of the outer ribs 17C, 17C . . . is m and the number of the inner ribs 17B, 17B . . . is m−1. Specifically, the number of the inner ribs 17B, 17B . . . is set to 8 smaller than the number of the outer ribs 17C, 17C . . .

With the above arrangement, sufficient strength to prevent expansion of the annular ribs 16, 16 . . . in the radial direction when a foreign matter enters between the annular ribs 16, 16 . . . is ensured. Further, the inner ribs 17B are connected to the blocking plate 14, whereby less number of the inner ribs 17B than the number of the outer ribs 17C invites no lowering of the strength at the central part of the fan guard 4. Therefore, the strength to prevent bending of the fan guard 4 at load application in the axial direction to the fan guard 4 is ensured and increase in ventilating resistance of forced airflow W from the blower fan 3 is suppressed. As a result, contact of the fan guard 4 into the blower fan 3 due to deformation of the fan guard 4 is prevented and noise and required input energy of the blower fan 3 are reduce. In addition, the blocking plate 14 and the outer frame 15 are connected by means of the eight extending ribs 17A, 17A . . . , whereby the strength against the load application in the axial direction to the fan guard 4 is increased.

Figure 3:
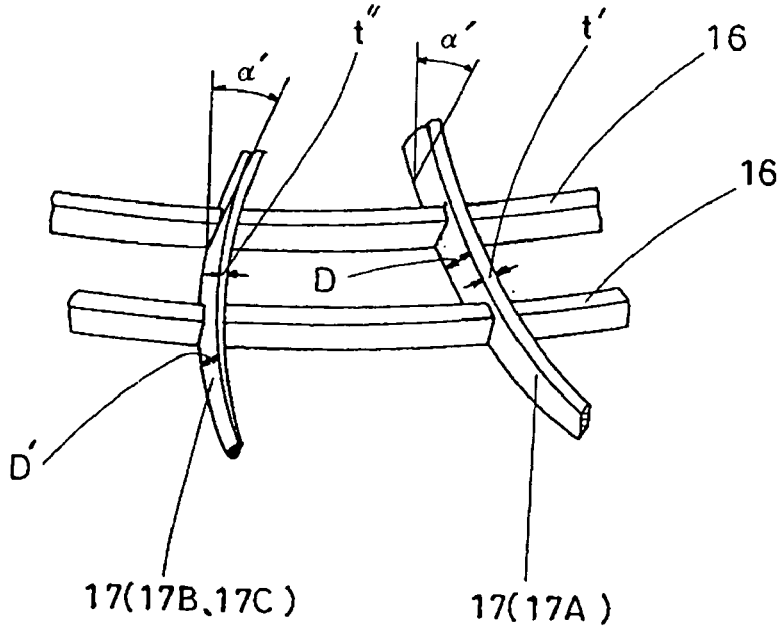
FIG. 3 is a fragmentary enlarged perspective view showing an essential part of the fan guard of the blower unit according to the first embodiment of the present invention.
Figure 4:
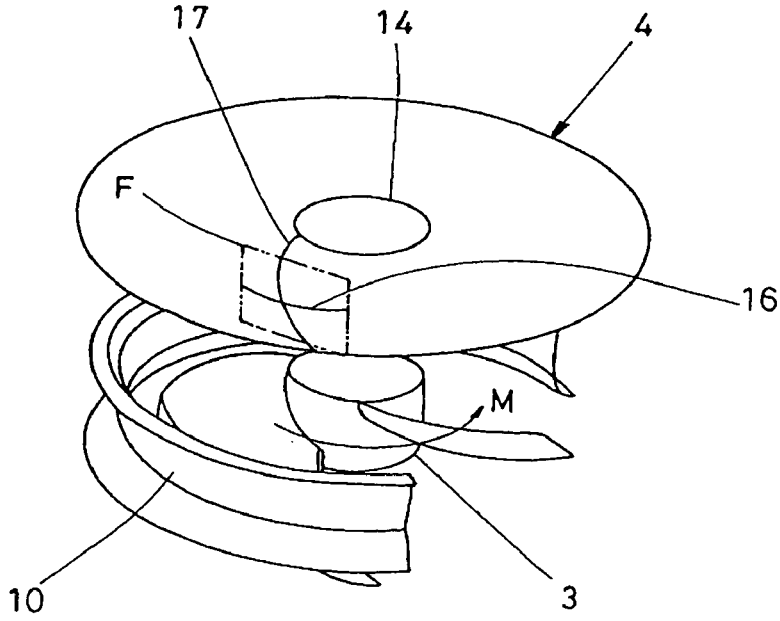
FIG. 4 is a perspective view, a part of which is taken away, of the fan guard and a blower fan of the blower unit according to the first embodiment of the present invention.

Moreover, the blocking plate 14, the outer frame 15, the extending ribs 17A, 17A . . . , the inner ribs 17B, 17B . . . , the outer ribs 17C, 17C . . . and the annular ribs 16, 16 . . . are integrally formed of a synthetic resin (see FIG. 3). The outer frame 15 is formed in a sleeve shape with a larger diameter than the outer diameter of the vanes 12, 12 . . . of the blower fan 3. The fan guard 4 is mounted by fitting the outer frame 15 to the air outlet 9 at the upper end of the wall portion 7*b*.

The extending ribs 17A, 17A . . . and the inner ribs 17B, 17B . . . are arranged radially in the radial direction from the blocking plate 14 and curves toward the downstream side of the rotational direction M of the blower fan 3. The outer ribs 17C, 17C . . . are arranged radially in the radial direction in the outer region Zo of the fan guard 4 and curves toward the downstream side of the rotational direction M of the blower fan 3. With this arrangement, the ribs 17A, 17B, 17C become easy to accord with the forced airflow blowing and radially expanding from the blower fan 3. Specifically, the ribs 17A, 17B, 17C curve toward the downstream side of the rotational direction M so as to form arcs (see FIG. 4).

Figure 16:
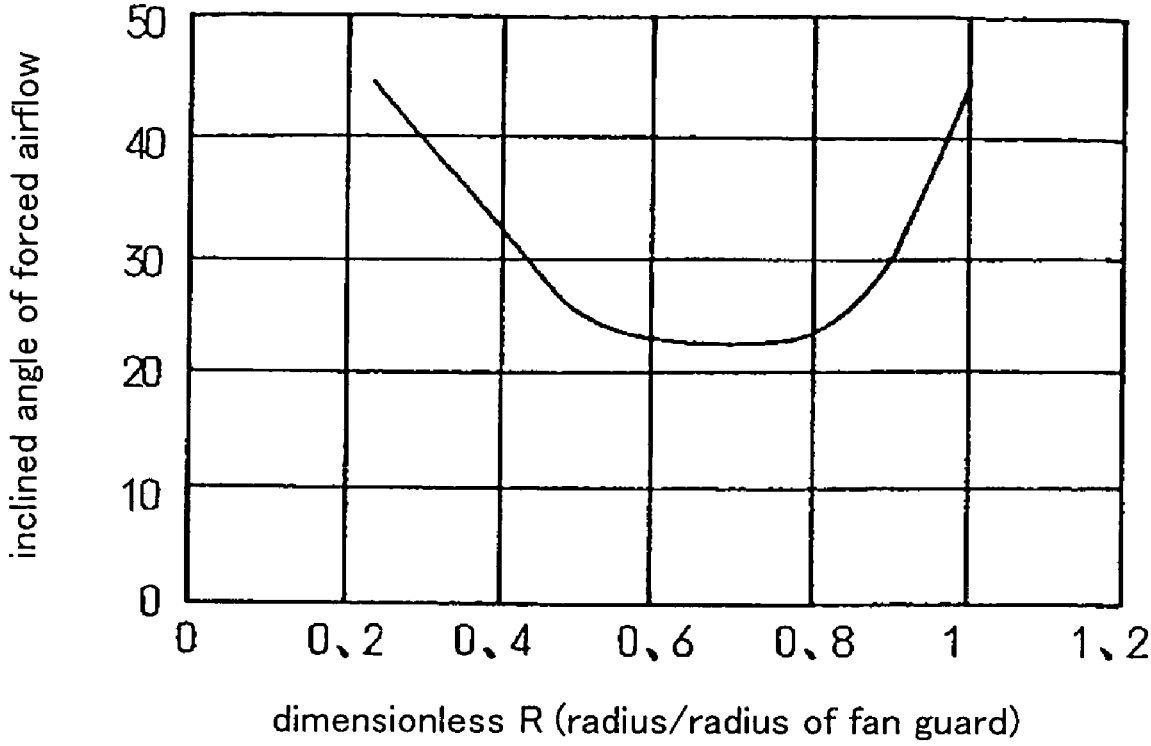
FIG. 16 is a characteristic graph showing a relationship between the dimensionless R (radius/radius of fan guard) and an inclined angle $\alpha$ (degree) of forced airflow by an axial fan.

In general, an inclined angle $\alpha$ of the turning forced airflow of the blower fan 3 (that is, an axial fan) is not constant in the entire region in the radial direction and changes in the radial direction. In detail, the inclined angle $\alpha$ of the forced airflow changes as in a downward curve with respect to a radial direction point (that is, dimensionless R=radius/radius of fan guard), as shown in FIG. 16. Namely, the inclined angle $\alpha$ of the forced airflow changes in the curve that decreases gradually toward the outer periphery from the hub of the axial fan, is the smallest at the point slightly outside the center, becomes constant in a predetermined region and increases gradually in the vicinity of the outer periphery. In short, the inclined angle $\alpha$ gradually changes substantially within the range from 20 degrees to 50 degrees.

Figure 5:
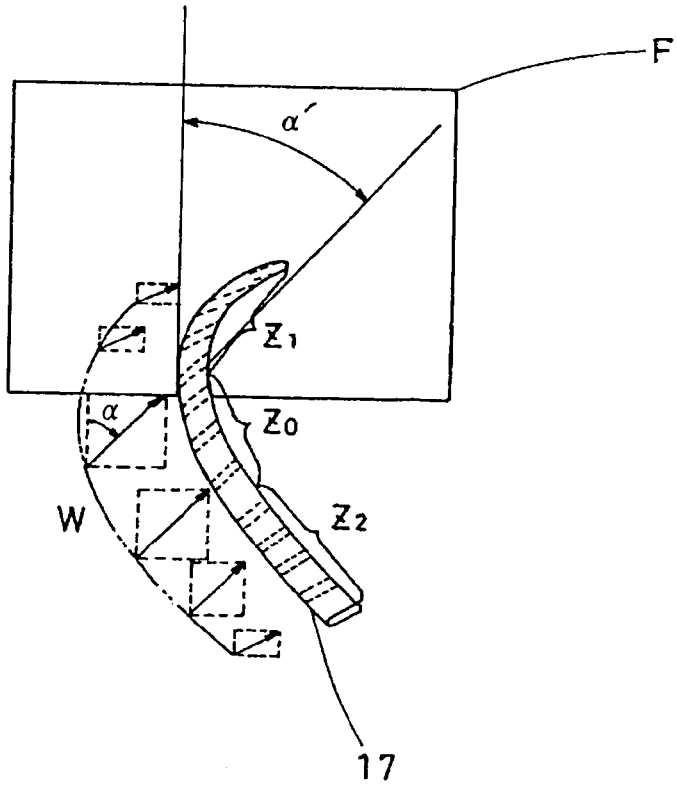
FIG. 5 is an explanatory drawing for determining the shape of radial ribs composing the fan guard of the blower unit according to the first embodiment of the present invention.

In the present embodiment, as shown in FIG. 5, the range of an inclined angle $\alpha'$ of the radial ribs (the extending ribs 17A, the inner ribs 17B and the outer ribs 17C) includes a constant region Z0 where the angle is the smallest (about 23 degrees, for example) at the center between the blocking plate 14 and the outer frame 15 and is substantially constant in a predetermined region, a decreasing region Z1 on the blocking plate 14 side with respect to the constant region Z0 and an increasing region Z2 on the outer frame 15 side with respect to the constant region Z0. In other words, the radial ribs (the extending ribs 17A, the inner ribs 17B and the outer ribs 17C) are inclined with respect to the rotation axis on a reference plane F parallel to the rotary shaft 13*a* of the blower fan 3 and the inclined angle α' of the radial ribs (the extending ribs 17A, the inner ribs 17B and the outer ribs 17C) changes in the radial direction gradually so as to correspond to the inclined angle α of the forced airflow W of the blower fan 3. Herein, it is desirable that the incline angle α' of the radial ribs (the extending ribs 17A, the inner ribs 17B and the outer ribs 17C) changes gradually within the range from 20 degrees to 50 degrees.

In other words, the chord direction of the radial ribs 17, 17 . . . in rib section on the plane F parallel to the rotary shaft 13*a* of the blower fan 3 inclines with respect to the rotation axis of the blowing fan 3 and the inclined angle α' of the ribs 17, 17 . . . in the chord direction changes in the radial direction so as to correspond to the inclined angle α of the forced airflow W of the blower fan 3.

Moreover, the range of the inclined angle α' of the radial ribs 17, 17 . . . includes the constant region Z0 where the inclined angle α' is the smallest at the center between the blocking plate 14 and the outer frame 15 and is substantially constant in the predetermined region, the decreasing region Z1 where the incline angle α' on the blocking plate 14 side with respect to the constant region Z0 decreases as it goes from the blocking plate 14 toward the constant region Z0, and the increasing region Z2 where the inclined angle α' on the outer frame 15 side with respect to the constant region Z0 increases as it approaches the outer frame 15.

With this arrangement, the change of the inclined angle α (see FIG. 16) of the forced airflow W with respect to the radial direction point (that is, dimensionless R=radius/radius of fan guard) agrees with the inclined angle α' of the radial ribs (the extending ribs 17A, the inner ribs 17B and the outer ribs 17C) in the entire range in the radial direction. As a result, interference between the forced airflow and the radial ribs, which is caused in the case where there is a region where the inclined angle of the forced airflow does not agree with the inclined angle of the radial ribs (that is, the blocking plate 14 side and the vicinity of the outer periphery) is hardly caused, thereby remarkably reducing noise and pressure loss.

The thickness t' of the extending ribs 17A, 17A . . . is set greater than the thickness t" of the inner ribs 17B, 17B . . . and the outer ribs 17C, 17C . . . , and the length D of the extending ribs 17A, 17A . . . in the flow direction of the forced airflow W is set longer than the length D' of the inner ribs 17B, 17B . . . and the outer ribs 17C, 17C . . . in the flow direction of the forced airflow W (see FIG. 3). With this arrangement, the rigidity of the extending ribs 17A, 17A . . . is increased, resulting in increases in the strength against deformation of the fan guard 4.

Figure 6:
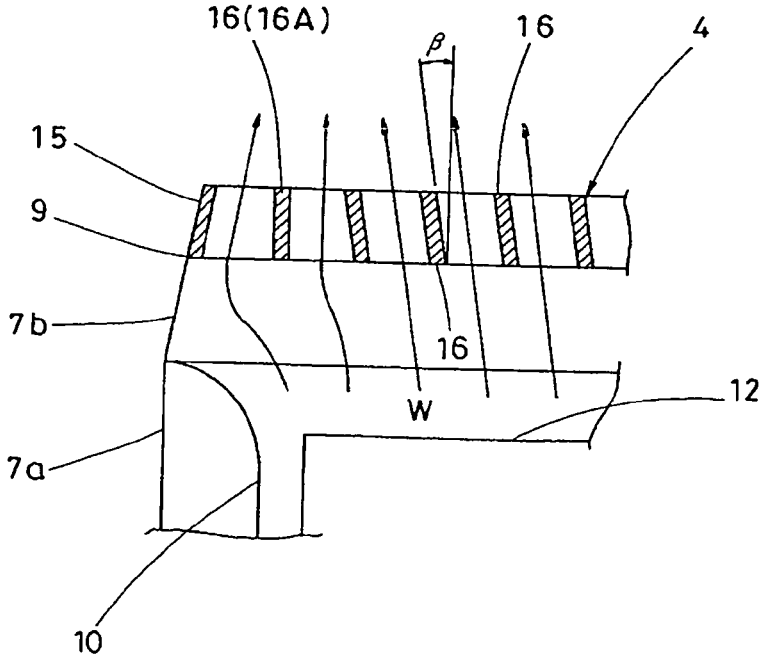
FIG. 6 is a fragmentary enlarged section of an essential part of the fan guard of the blower unit according to the first embodiment of the present invention.

In this embodiment, the annular ribs 16, 16 . . . located outside of the substantial center in the radial direction inclines outward and the inclined angle β thereof gradually decreases in the vicinity of the outermost periphery, as shown in FIG. 6. In this case, the wall portion 7*b* of the upper rid member 7 and the outer frame 15 of the fan guard 4 inclines inward with respect to the rotary shaft 13*a* of the blower fan 3. With this arrangement, the outwardly expanding flow from the blower fan 3 (that is, the forced airflow W) flows along the annular ribs 16, 16 . . . , whereby interference between the annular ribs 16 and the forced airflow W is reduced and the flow direction of the forced airflow W flowing between the annular ribs 16 is corrected in the axial direction in the vicinity of the outermost periphery, thereby causing no occlusion of the forced airflow W and reducing pressure loss.

It is desirable that the inclined angle β of the outermost annular rib 16A out of the annular ribs 16, 16 . . . is set substantially equal to the inclined angle of the outer frame 15. In so doing, the forced airflow W smoothly flows between the outermost annular rib 16A and the outer frame 15, whereby noise increase is suppressed and the pressure loss is reduced. Wherein, the outer frame 15 may be arranged in parallel to the rotary shaft 13*a* of the blower fan 3.

Figure 7:
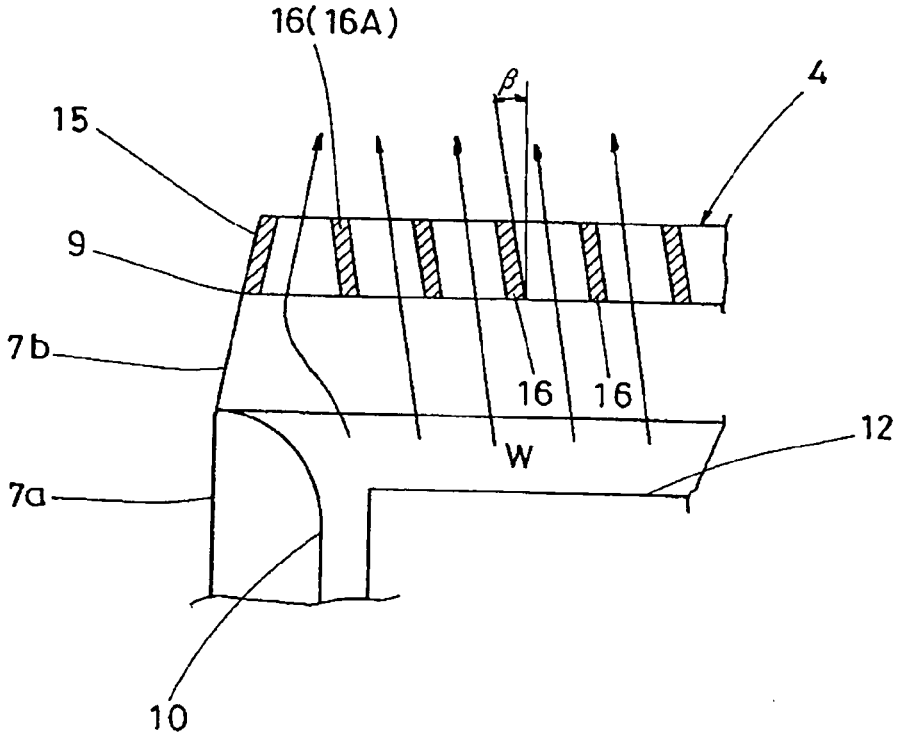
FIG. 7 is a fragmentary enlarged section of an essential part of a fan guard of a blower unit in a modified example according to the first embodiment of the present invention.
Figure 8:
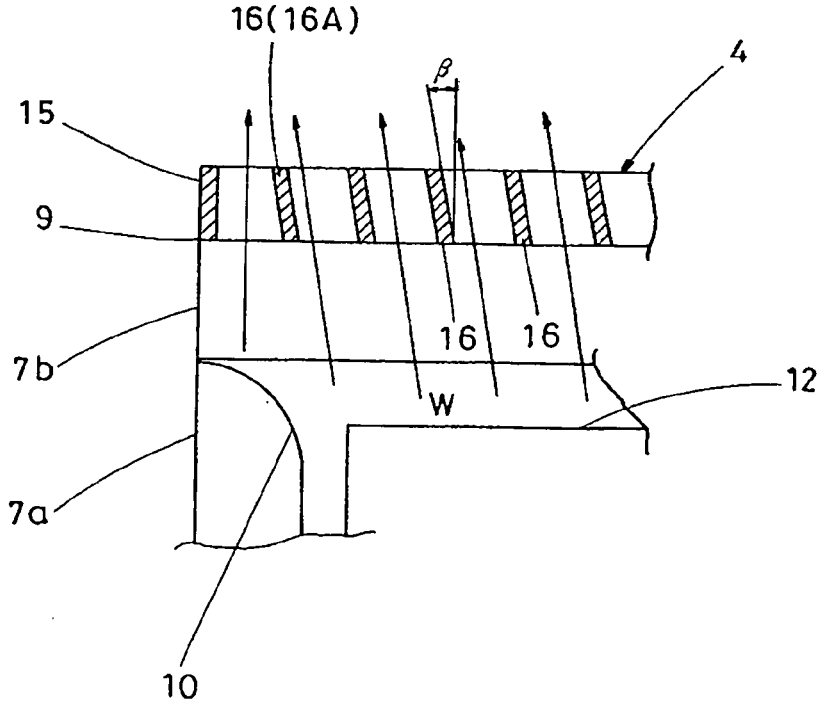
FIG. 8 is a fragmentary enlarged section of an essential part of a fan guard of a blower unit in another modified example according to the first embodiment of the present invention.

Further, the annular ribs 16, 16 . . . located outside the substantial center in the radial direction may incline outward at a predetermined angle β (for example, β=5 degrees to 15 degrees), as shown in FIG. 7. Or, it is possible that the outer frame 15 is arranged in parallel to the rotary shaft 13*a* of the blower fan 3 and the annular ribs 16, 16 . . . located outside the substantial center in the radial direction inclines outward at a predetermined angle β (for example, β=5 degrees to 15 degrees).

Figure 9:
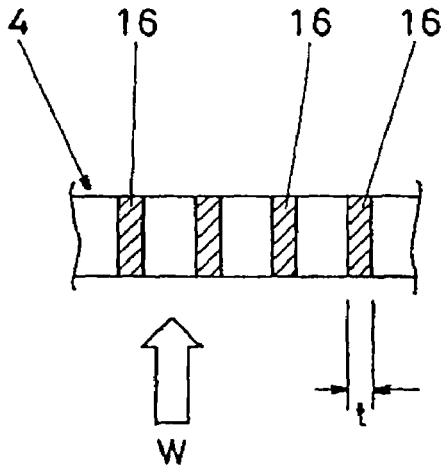
FIG. 9 is an enlarged section of annular ribs of the fan guard of the blower unit according to the first embodiment of the present invention.
Figure 10:
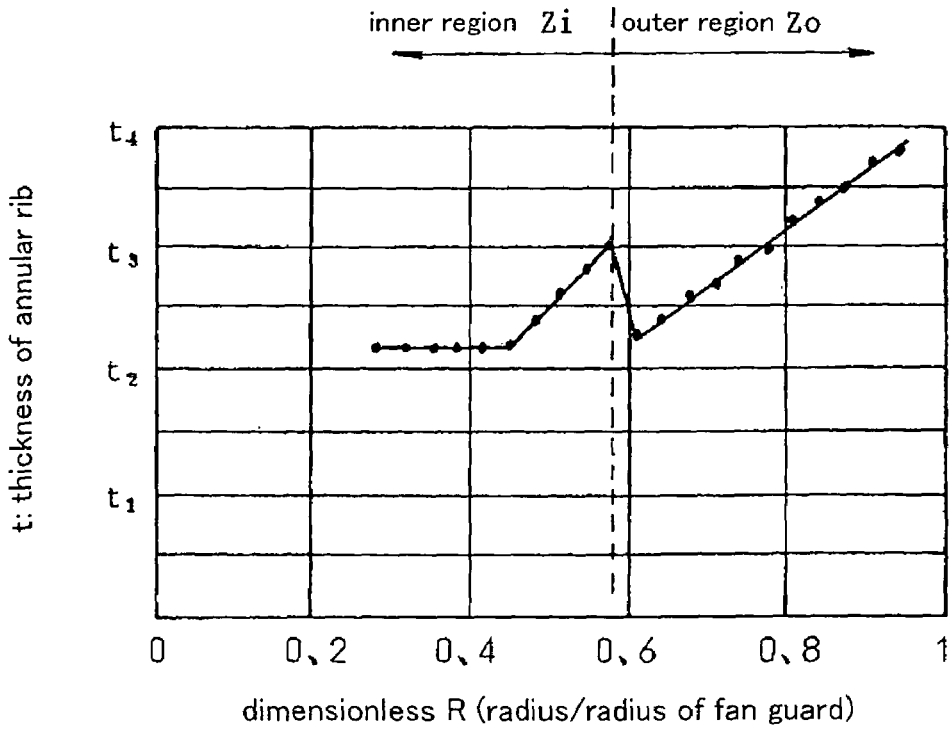
FIG. 10 is a characteristic graph showing a change in thickness of the annular ribs, which corresponds to dimensionless R (radius/radius of fan guard), of the fan guard of the blower unit according to the first embodiment of the present invention.

Meanwhile, in the present embodiment, as shown in FIG. 9 and FIG. 10, the thickness t of the annular ribs 16, 16 . . . increases gradually from the central part to a boundary annular rib 16B, which serves as the boundary between the inner region Zi and the outer region Zo to which the inner ribs 17B, 17B . . . and the outer ribs 17C, 17C . . . are connected, is the greatest at the boundary annular rib 16B, decreases toward the outer annular ribs 16C located outside the boundary annular rib 16B, and then, increases gradually toward the outer periphery therefrom. With this arrangement, the thickness t of the annular ribs 16, 16 . . . increases as the intervals of the inner ribs 17B, 17B . . . and the outer ribs 17C, 17C . . . increases, whereby the strength to prevent expansion of the annular ribs 16, 16 . . . in the radial direction can be ensured. Further, the thickness t of the boundary annular rib 16B, which serves as the boundary between the inner region Zi and the outer region Zo to which the inner ribs 17B, 17B . . . and the outer ribs 17C, 17C . . . are connected, is the greatest, whereby the boundary annular rib 16B exhibits a function as an outer frame for the inner ribs 17B, 17B . . . and a function as an inner frame for the outer fibs 17C, 17C . . . . with a result that the strength of the fan guard 4 is increased as a whole.

Second Embodiment

Figure 11:
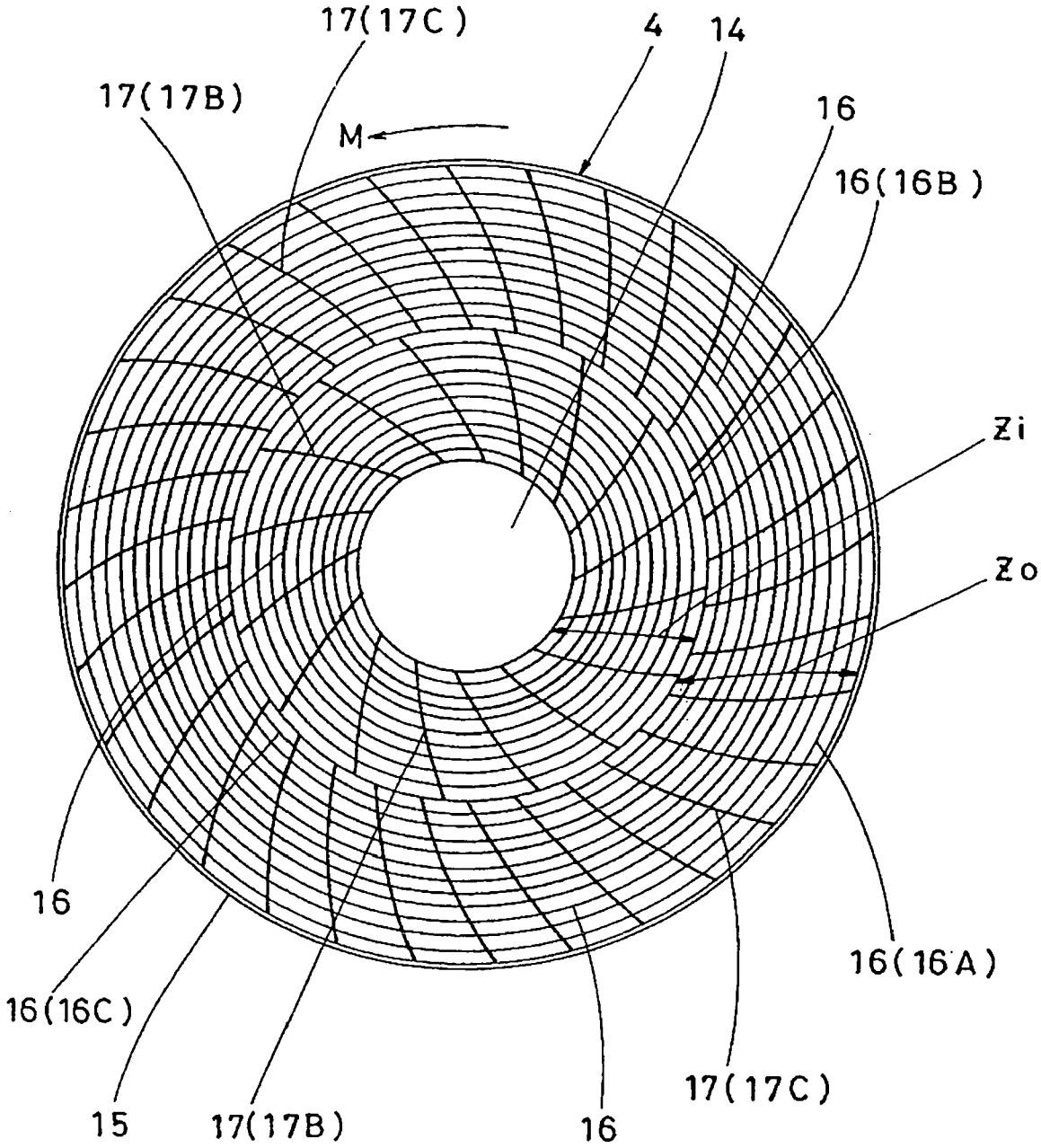
FIG. 11 is a plan view showing a fan guard of a blower unit according to a second embodiment of the present invention.

FIG. 11 shows a fun guard of a blower fan according to the second embodiment of the present invention.

In this case, the radial ribs 17, 17 . . . include the inner ribs 17B, 17B . . . extending from the blocking plate 14 to the substantial center in the radial direction in the inner region Zi ranged from the blocking plate 14 to the substantial center in the radial direction, and the outer ribs 17C, 17C . . . extending from the substantial center in the radial direction to the outer frame 15 in the outer region Zo ranging from the substantial center in the radial direction to the outer frame 15. The outer ribs 17C, 17C . . . and the inner ribs 17B, 17B . . . are arranged at regular intervals in the peripheral direction. The number of the inner ribs 17B, 17B . . . is smaller than the number of the outer ribs 17C, 17C . . . (½ in the present embodiment).

With this arrangement, sufficient strength to prevent expansion of the annular ribs 16, 16 . . . in the radial direction when a foreign matter enters between the annular ribs 16, 16 . . . is ensured. Also, the inner ribs 17B are connected to the blocking plate 14, whereby less number of the inner ribs 17B than the number of the outer ribs 17C invites no lowering of the strength at the central part of the fan guard 4. Hence, the strength to prevent bending of the fan guard 4 at load application in the axial direction to the fan guard 4 can be ensured and the increase in the ventilating resistance of the forced airflow W from the blower fan 3 can be suppressed.

As a result, contact of the fan guard 4 into the blower fan 3 due to deformation of the fan guard 4 is prevented and noise and required input energy of the blower fan 3 are reduced.

It should be noted that the intervals of the inner ribs 17B, 17B . . . and the outer ribs 17C, 17C . . . in the peripheral direction (in other words, the number of ribs) are set so that a foreign matter (fingers, for example) hardly enters, and the number of the inner ribs 17B, 17B . . . is set smaller than the number of the outer ribs 17C, 17C . . . Because the other constitution, operation and effects are the same as those in the first embodiment, the explanation thereof is omitted.

Third Embodiment

Figure 12:
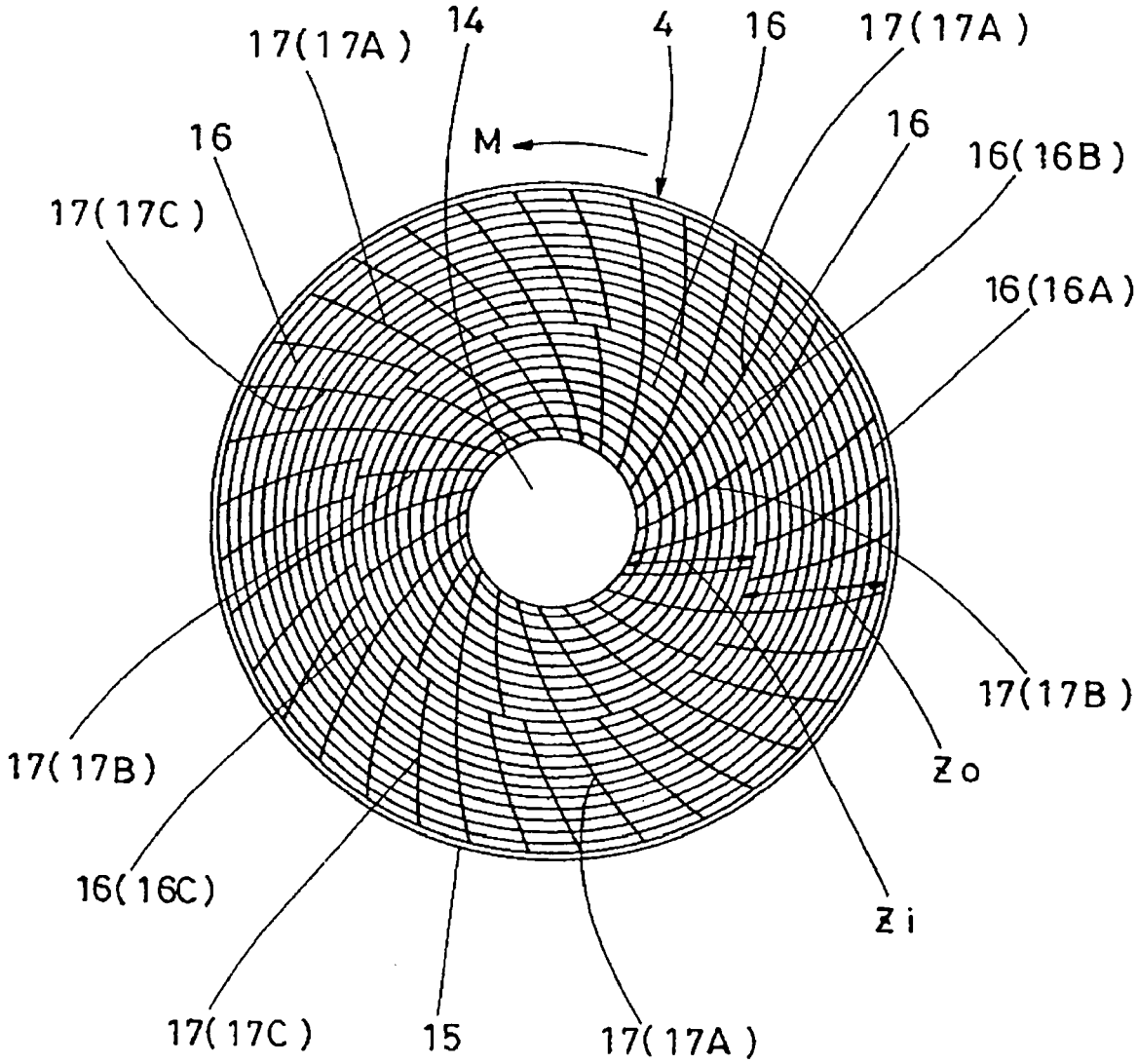
FIG. 12 is a plan view showing a fan guard of a blower unit according to a third embodiment of the present invention.

FIG. 12 shows a fan guard of a blower unit according to the third embodiment of the present invention.

In this case, the number of the extending ribs 17A, 17A . . . is set to 12. The number of the outer ribs 17C, 17C . . . between the adjacent extending ribs 17A, 17A is set to 2 (m=2). Accordingly, the number of the inner ribs 17B, 17B . . . is set to ½ of the number of the outer ribs 17C, 17C . . . Wherein, the blocking plate 14 may be in the shape of a rectangle. With this arrangement, the strength of the fan guard 4 is increased by the increased number of the extending ribs 17A, 17A . . . Because the other constitution, operation and effects are the same as those in the first embodiment, the explanation thereof is omitted.

Fourth Embodiment

Figure 13:
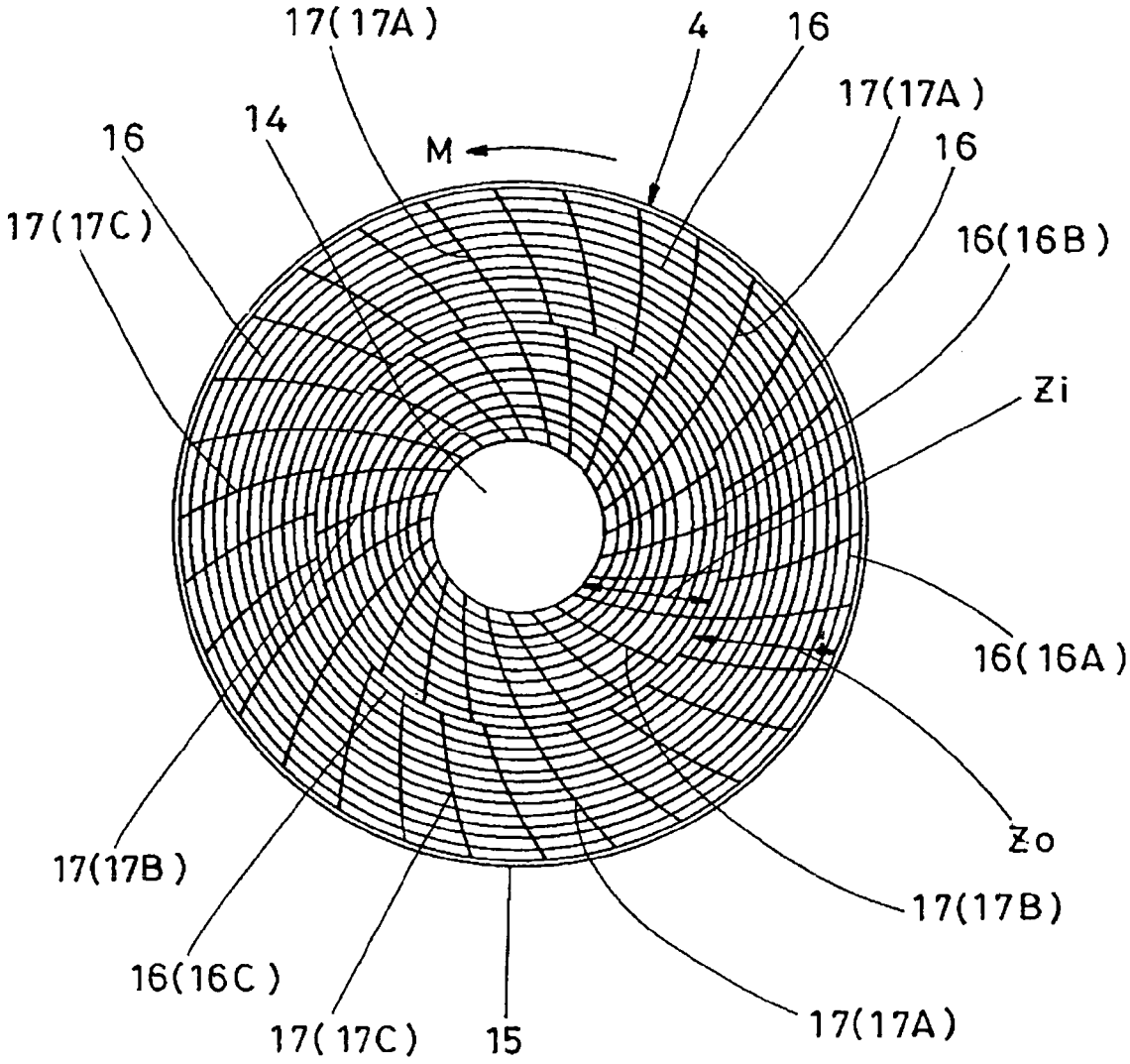
FIG. 13 is a plan view showing a fan guard of a blower unit according to a fourth embodiment of the present invention.

FIG. 13 shows a fan guard of a blower unit according to the fourth embodiment of the present invention.

In this case, the number of the extending ribs 17A, 17A . . . is set to 6. The number of the outer ribs 17C, 17C . . . between the adjacent extending ribs 17A, 17A is set to 4 (m=4). Accordingly, the number of the inner ribs 17B, 17B . . . is set to be 6 smaller than the number of the outer ribs 17C, 17C. . . Wherein, the blocking plate 14 may be in the shape of a rectangle. With this arrangement, the strength of the fan guard 4 is slightly lowered by the reduced number of the extending ribs 17A, 17A . . . Because the other constitution, operation and effects are the same as those in the first embodiment, the explanation thereof is omitted.

Fifth Embodiment

Figure 14:
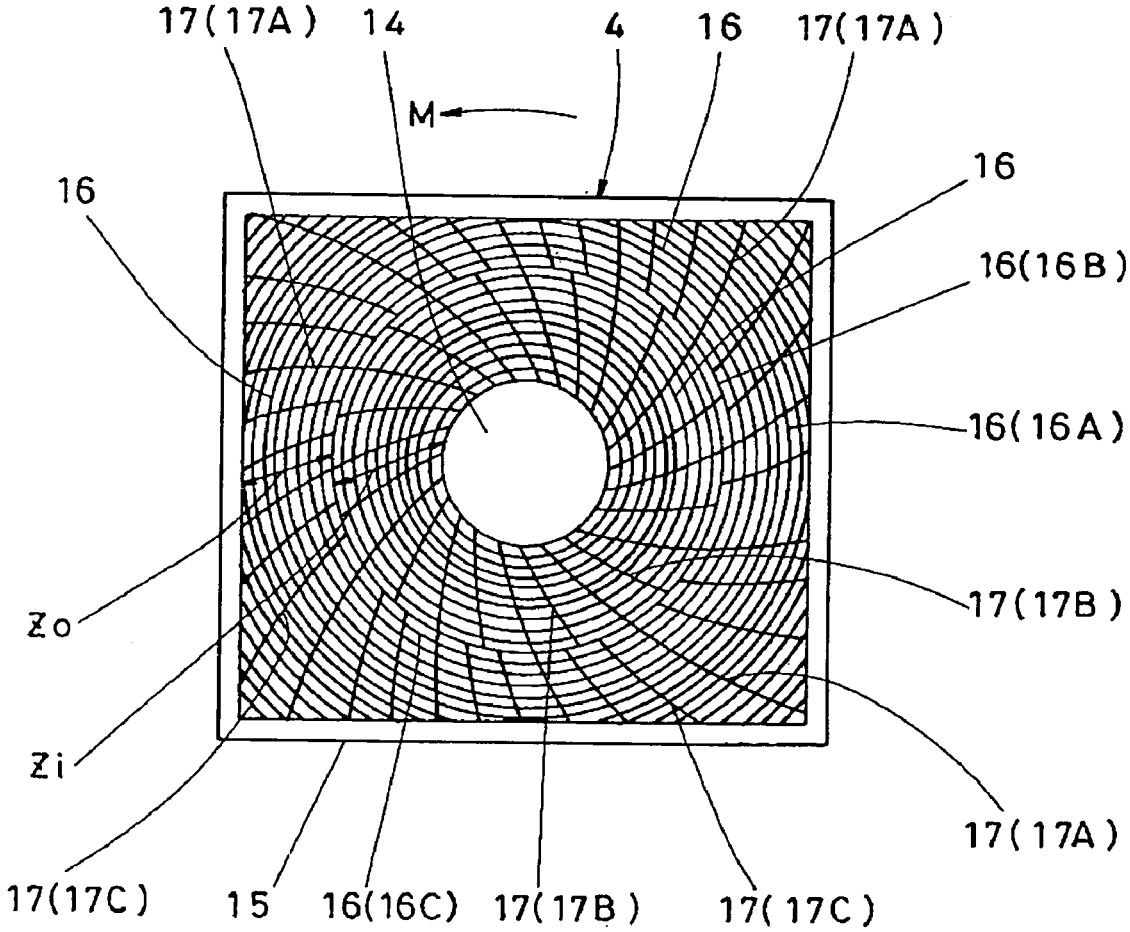
FIG. 14 is a plan view showing a fan guard of a blower unit according to a fifth embodiment of the present invention.

FIG. 14 shows a fan guard of a blower unit according to the fifth embodiment of the present invention.

In this case, the outer frame 15 of the fan guard 4 is in the shape of a rectangle. The number of the extending ribs 17A, 17A . . . is set to 12, and the number of the outer ribs 17C, 17C . . . between the adjacent extending ribs 17A, 17A is set to 2(m=2). Accordingly, the number of the inner ribs 17B, 17B . . . is set to ½ of the number of the outer ribs 17C, 17C. . . Wherein, the blocking plate 14 may be in the shape of a rectangle. With this arrangement, the strength of the fan guard 4 is increased by the increased number of the extending ribs 17A, 17A . . . Because the other constitution, operation and effects are the same as those in the first embodiment, the explanation thereof is omitted.

Sixth Embodiment

Figure 15:
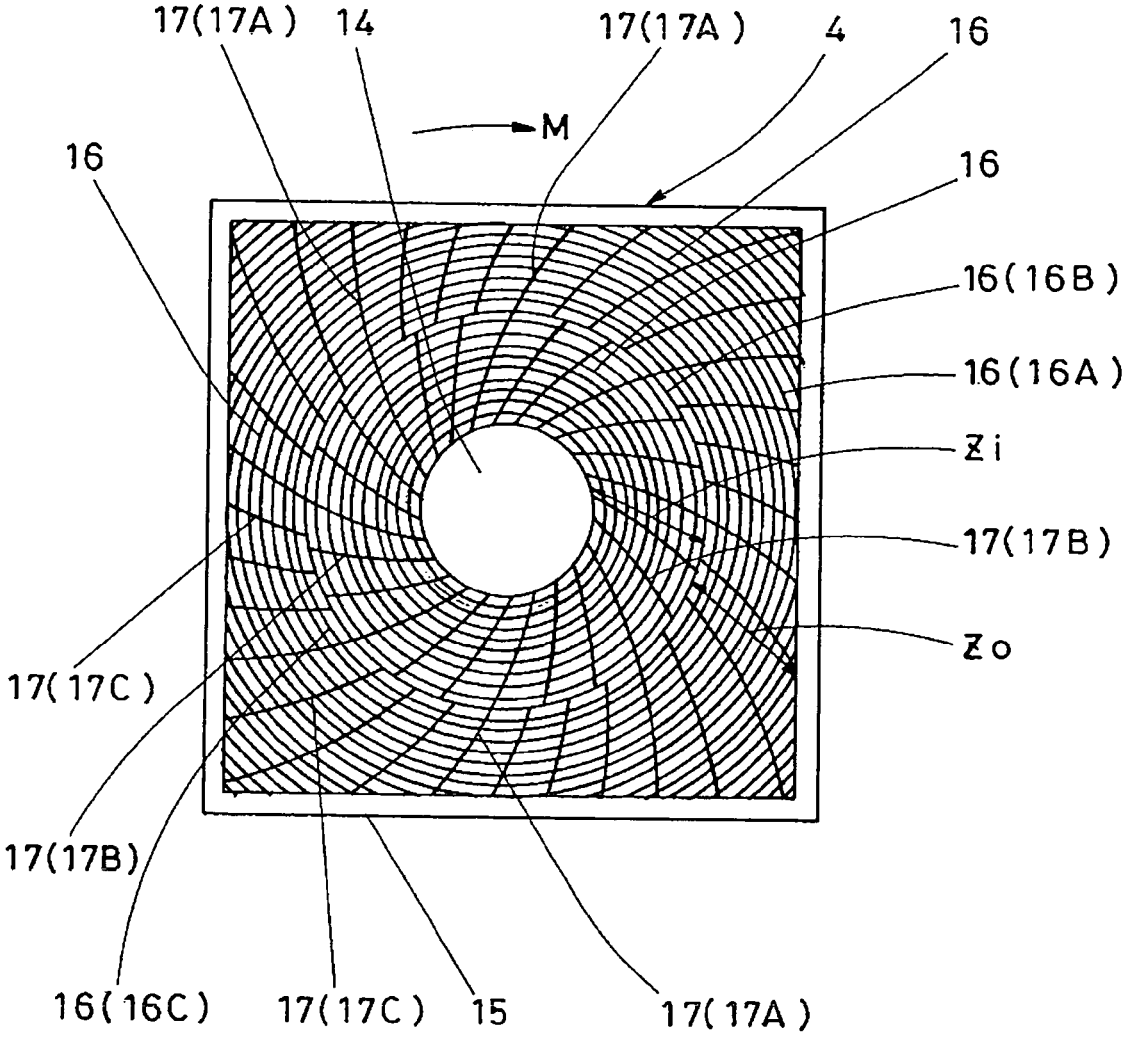
FIG. 15 is a plan view showing a fan guard of a blower unit according to a sixth embodiment of the present invention.

FIG. 15 shows a fun guard of a blower unit according to the sixth embodiment of the present invention.

In this case, the outer frame 15 of the fan guard 4 is in the shape of a rectangle. The number of the extending ribs 17A, 17A . . . is set to 8, and the number of the outer ribs 17C, 17C . . . between the adjacent extending ribs 17A, 17A is set to 3 (m=3). Accordingly, the number of the inner ribs 17B, 17B . . . is set to be 8 smaller than the number of the outer ribs 17C, 17C. . . Wherein, the blocking plate 14 may be in the shape of a rectangle. Because the other constitution, operation and effects are the same as those in the first embodiment, the explanation thereof is omitted.

INDUSSTRIAL APPLICABILITY

As described above, the fan guard of the blower unit according to the present invention is useful when applied to outdoor units of air conditioners, and is especially suitable for outdoor units having annular ribs and radial ribs.

The invention claimed is:

1. A fan guard of a blower unit, comprising:

a plurality of annular ribs, provided between a blocking plate arranged at a central part and an outer frame arranged at an outer periphery, arranged coaxially in a radial direction at predetermined intervals with the center of the blocking plate as a center, and a plurality of radial ribs extending radially and arranged at regular intervals in a peripheral direction, wherein the fan guard is mounted at an air outlet of the blower unit having a blower fan, wherein:

the radial ribs include a plurality of inner ribs extending from the blocking plate to a substantial center in the radial direction and arranged at regular intervals in the peripheral direction, wherein the inner ribs terminate at the substantial center in the radial direction and a plurality of outer ribs extending from the substantial center in the radial direction to the outer frame and arranged at regular intervals in the peripheral direction, and the number of the inner ribs is set smaller than the number of the outer ribs.

2. The fan guard of the blower unit of claim 1, wherein:

the radial ribs include a plurality of extending ribs extending from the blocking plate to the outer frame and arranged at regular intervals in the peripheral direction, the inner ribs are arranged between the extending ribs, and the inner ribs and the extending ribs are arranged at regular intervals in the peripheral direction, and the outer ribs are arranged between the extending ribs, and the outer ribs and the extending ribs are arranged at regular intervals in the peripheral direction.

3. The fan guard of the blower unit of claim 2, wherein:

a thickness (t') of the extending ribs is set greater than each thickness (t") of the inner ribs and the outer ribs.

4. The fan guard of the blower unit of claim 2, wherein:

a length (D) of the extending ribs in a flow direction of forced airflow (W) from the blower fan is set longer than each length (D') of the inner ribs and the outer ribs in the flow direction of the forced air flow (W).

5. The fan guard of the blower unit of claim 1 or 2, wherein:

one of the annular ribs functions as a boundary annular rib serving as a boundary of an inner region (Zi) and an outer region (Zo), the inner ribs and the outer ribs are connected to the boundary annular rib, a thickness (t) of the annular ribs in the inner region (Zi) increases gradually from the central part to the boundary annular rib, a thickness (t) of the boundary annular rib is the greatest, a thickness (t) of outer annular ribs located outside the boundary rib decreases and a thickness (t) of the annular ribs in the outer region (Zo) increases from the thinner annular ribs toward the outer periphery.

6. The fan guard of the blower unit of claim 1 or 2, wherein:

a chord direction of the radial ribs in a rib section on a plane (F) parallel to a rotary shaft of the blower fan inclines with respect to a rotation axis, and an inclined angle ($\alpha'$) of the radial ribs in the chord direction changes in the radial direction so that the inclined angle ($\alpha'$) corresponds to an inclined angle ($\alpha$) of the forced airflow (W) of the blower fan.

7. The fan guard of the blower unit of claim 6, wherein:

a range of the inclined angle $\alpha'$ of the radial ribs includes: a constant region (Z0) where the inclined angle ($\alpha'$) is the smallest at the center between the blocking plate and the outer frame and is substantially constant in a predetermined region; a decreasing region (Z1) on the blocking plate side with respect to the constant region (Z0) where the inclined angle ($\alpha'$) decreases as it goes from the blocking plate toward the constant region (Z0); and an increasing region (Z2) on the outer frame side with respect to the constant region (Z0) where the inclined angle ($\alpha'$) increases as it goes toward the outer frame (Z0).

8. The fan guard of the blower unit of claim 6, wherein:

the inclined angle ($\alpha'$) of the radial ribs changes in a range from 20 degrees to 50 degrees.

9. The fan guard of the blower unit of claim 1 or 2, wherein:

the annular ribs located outside the substantial center in the radial direction incline outward and an inclined angle ($\beta$) thereof gradually decreases as it approaches the annular ribs in a vicinity of an outermost periphery.

10. The fan guard of the blower unit of claim 1 or 2, wherein:

the outer frame is in parallel to or inclines inward with respect to a rotary shaft of the blower fan, and an inclined angle of an outermost annular rib out of the annular ribs is substantially equal to an inclined angle of the outer frame.

11. An apparatus for guarding a blower, comprising:

a plurality of annular ribs, each coaxially distributed and radially displaced between the center of a blocking plate and an outer frame; and a plurality of radial ribs, each distributed radially in a circumferential direction, wherein the radial ribs further comprise outer ribs extending in the radial direction between a substantial center and the outer frame, and inner ribs extending in the radial direction between the blocking plate and the substantial center, wherein the inner ribs terminate at the substantial center in the radial direction, and wherein the number of inner ribs is less than the number of outer ribs.

12. The apparatus according to claim 11, wherein the plurality of radial ribs further comprises:

extending ribs extending between the blocking plate and the outer frame.

13. The apparatus according to claim 12, wherein the inner ribs are arranged between the extending ribs.

14. The apparatus according to claim 12, wherein the outer ribs are arranged between the extending ribs.

15. The apparatus according to claim 12, wherein a thickness of the extending ribs is set greater than the thickness of the inner ribs and the thickness of the outer ribs.

16. The apparatus according to claim 12, wherein a length of the extending ribs in a direction of forced airflow is set longer than the corresponding lengths of the inner ribs and the outer ribs.

17. The apparatus according to claim 12, wherein the annular ribs further comprises:

a boundary annular rib which borders an inner region and an outer region, wherein the boundary annular rib is connected with the inner ribs and the outer ribs.

* * * * *